US007765930B2

(12) United States Patent
Schneider et al.

(10) Patent No.: US 7,765,930 B2
(45) Date of Patent: Aug. 3, 2010

(54) METHODS FOR SETTING THE CONTACT PRESSURE OF A DISPLACEABLY MOUNTED ROLLER

(75) Inventors: Georg Schneider, Würzburg (DE); Bernd Klaus Faist, Ochsenfurt (DE); Peter Jentzsch, Rottendorf (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/153,937

(22) Filed: May 28, 2008

(65) Prior Publication Data

US 2008/0229960 A1 Sep. 25, 2008

Related U.S. Application Data

(62) Division of application No. 10/528,468, filed as application No. PCT/DE03/02946 on Sep. 5, 2003, now Pat. No. 7,387,069.

(30) Foreign Application Priority Data

Sep. 21, 2002 (DE) ..... 102 44 046

(51) Int. Cl.

| | |
|---|---|
| ***B41F 1/34*** | (2006.01) |
| ***B41F 21/12*** | (2006.01) |
| ***B41F 21/14*** | (2006.01) |
| ***B41F 7/02*** | (2006.01) |
| ***B41L 1/02*** | (2006.01) |

(52) U.S. Cl. ..... 101/485; 101/218

(58) Field of Classification Search ..... 101/218, 101/247, 143–145, 352.01
See application file for complete search history.

(56) References Cited

U.S. PATENT DOCUMENTS

| | | | | |
|---|---|---|---|---|
| 2,306,044 | A * | 12/1942 | Davidson | 101/144 |
| 2,774,301 | A | 12/1956 | Worthington | |
| 3,157,118 | A | 11/1964 | Mosemiller | |
| 3,389,450 | A | 6/1968 | Robertson | |
| 4,899,656 | A | 2/1990 | Thomas et al. | |
| 5,048,362 | A | 9/1991 | Becker et al. | |
| 5,448,949 | A * | 9/1995 | Bucher | 101/216 |
| 5,575,572 | A | 11/1996 | Schaede | |

(Continued)

FOREIGN PATENT DOCUMENTS

| | | |
|---|---|---|
| DE | 64 064 | 10/1968 |

(Continued)

*Primary Examiner*—Judy Nguyen
*Assistant Examiner*—Leo T Hinze
(74) *Attorney, Agent, or Firm*—Jones, Tullar & Cooper, P.C.

(57) ABSTRACT

A method is used to set a contact pressure between a displaceable roller and another roller or for moving the displaceable roller with respect to the other roller. At least one actuator is subjectible to the action of a pressure medium and presses the displaceable roller toward the other roller with an adjustable force. The pressure of the pressure medium can be adjusted by a valve. A switchover device is provided for use in connecting the valve to different actuators, as desired.

5 Claims, 6 Drawing Sheets

U.S. PATENT DOCUMENTS

| | | | | |
|---|---|---|---|---|
| 5,967,043 | A | 10/1999 | Mayr | |
| 6,098,542 | A | 8/2000 | Dufour | |
| 6,230,622 | B1 * | 5/2001 | Dilling | 101/484 |
| 6,761,112 | B2 | 7/2004 | Faisat et al. | |
| 7,021,209 | B2 | 4/2006 | Faist et al. | |
| 7,124,683 | B2 | 10/2006 | Faist et al. | |
| 7,258,065 | B2 | 8/2007 | Faist et al. | |
| 7,387,069 | B2 * | 6/2008 | Schneider et al. | 101/352.01 |
| 2004/0112232 | A1 | 6/2004 | Faist et al. | |

FOREIGN PATENT DOCUMENTS

| | | | |
|---|---|---|---|
| DE | 1 611 303 | | 12/1970 |
| DE | 38 08 142 | A1 | 9/1989 |
| DE | 42 31 673 | A1 | 3/1994 |
| DE | 44 36 629 | A1 | 4/1996 |
| DE | 197 19 305 | A1 | 11/1998 |
| DE | 199 19 733 | A1 | 11/1999 |
| DE | 100 01 582 | A1 | 8/2000 |
| GB | 1 212 801 | | 11/1970 |
| GB | 1 213 903 | | 11/1970 |
| GB | 1 213 935 | | 11/1970 |
| GB | 2 271 082 | A | 4/1994 |
| WO | WO 03/049947 | A2 | 6/2003 |
| WO | WO 03/049948 | A2 | 6/2003 |

* cited by examiner

METHODS FOR SETTING THE CONTACT PRESSURE OF A DISPLACEABLY MOUNTED ROLLER

CROSS-REFERENCE TO RELATED APPLICATIONS

This U.S. patent application is a division of U.S. application Ser. No. 10/528,468, filed Mar. 21, 2005, now U.S. Pat. No. 7,387,069, issued Jun. 17, 2008. That application was the U.S. national phase, under 35 U.S.C. 371, of PCT/DE2003/002946, filed Sep. 5, 2003; published as WO 2004/028810A1 on Apr. 8, 2004, and claiming priority to DE 102 44 046.8, filed Sep. 21, 2002, the disclosures of which are expressly incorporated herein by reference.

FIELD OF THE INVENTION

The present invention is directed to methods for setting the contact pressure of a displaceably seated roller. The contact pressure, or a spacing distance between the displaceable roller and a second roller is variable by the use of an actuator that can be charged with a pressure medium.

BACKGROUND OF THE INVENTION

A plurality of rollers are contained in generally conventional printing presses, such as web-fed rotary printing presses, for example. Inking rollers, in particular, are provided in such presses, which inking rollers are used for transferring ink from an ink reservoir to the plate cylinder. It is possible to meter the ink that is transferred to the plate cylinder by the inking rollers, so that the ink is being transferred as a uniform film of a defined thickness. Because of this, it is possible to compensate for interferences, such as for example, fluctuations in speed and rotary vibrations.

Dampening rollers can also be provided. These dampening rollers transfer a dampening agent, for example water, to the printing group.

Pairs of rollers are often formed by rollers which are in engagement with each other. At least one of the rollers in the pair has a cylinder surface made of an elastic material, so that this cylinder surface can be deformed at least slightly, depending on the contact pressure exerted on it by the roller opposite it. As a result, a contact area, which extends in a straight line between the rollers, and which is called a contact strip, appears because of the elastic deformation of the roller surface. The circumferential width of the contact strip can be varied by adjusting the contact pressure between the rollers. The width of this contact strip has a considerable effect on the print result. If, for example, the contact strip in an inking unit is too narrow, not enough ink is being transferred. In cases in which the contact strips are too wide, the elastic roller can be damaged by the kneading effect occurring because of this excessively wide contact strip.

To be able to always correctly adjust the strip width, in particular as a function of the press operating conditions, such as, for example, the temperature of the printing presses or their degree of wear, it is necessary to seat one of the rollers displaceably. This displaceably seated roller can be pushed, by an actuator, with an adjustable force, in a direction toward the opposite roller. Once the correct contact pressure between the two rollers has been found, a fixation device for use in fixing the first roller in place, with respect to the second roller, is operated to maintain the contact pressure permanently.

A device for setting a contact pressure between two rollers is known from DE 197 19 305 A1. By use of the seating arrangement described in that document, the displaceably seated roller is pressed against the opposite roller by a spring, which spring is supported on the frame of the printing press. Because of this spring-biased roller displacement, a defined contact pressure between the two rollers always occurs as a function of the respectively selected characteristic curve of the spring. A clamping mechanism, with a clamping lever and with a clamping plate, and useable for fixing the roller in the pressed-on place, is described, by the use of which clamping mechanism the roller shaft can be fixed in place on the frame of the printing press by a frictional connection.

A device for the semi-automatic adjustment of rollers is known from DE 199 19 733 A1. An adjustably seated roller is maintained in a roller holder, which, in turn, is seated in a frame holder that is fixedly arranged on the frame. In this case, the roller holder and the frame holder can be displaced, in relation to each other, and are connected with each other by a spring-elastic assembly. The spring-elastic assembly here has a defined prestress, so that the roller, which is displaceably seated on the roller holder, can be pressed against the opposite roller with a defined contact pressure. Arresting bolts are provided for use in fixing the roller holder in place on the frame holder, and by whose advancement, the roller holder can be clamped, in a frictionally connected manner, on the frame holder.

DE 38 08 142 A1 describes a device for seating two cylinders. In this case, a contact pressure between two rollers, which two rollers can be placed against and away from each other, can be changed by altering the pressure of a pressure medium. A switching device is also provided, by use of which, the pressure medium can be selectively conducted to different actuators.

DE-OS 16 11 303 discloses a device for bringing a printing cylinder of a rotogravure press into and out of contact. A pressure reduction valve is provided.

Inking rollers are known from U.S. Pat. No. 2,774,301 and GB 1 213 935. These rollers can be brought into contact by the use of actuators which are operated by a pressure medium. Here, a valve for setting the level of the pressure and at least one shut-off valve are provided.

SUMMARY OF THE INVENTION

The object of the present invention is directed to providing methods for setting a contact pressure of an adjustably seated roller.

In accordance with the present invention, this object is attained by the provision of a method for setting the contact pressure between a displaceably seated first roller and a second roller. At least one actuator, which is chargeable with a pressure medium, is utilized. Two valves can be used to form two different contact pressures. The operation of the actuator can take place in a timed manner. If the second roller has a break in its surface, the contact between the rollers takes place at a defined angular position of the second roller. The movement of the one roller takes place at a low number of roller revolutions or speed. Selectively actuatable fixation devices can be used to hold selected rollers in position.

The actuator, which is useable for setting the contact pressure of the devices, is embodied in the manner of a pressure body, which pressure body can be charged with a pressure medium, such as a precompressed gas, and in particular compressed air. Valves are provided for use in adjusting the pressure of the pressure medium in order to be able to set the contact pressure. Since a multitude of adjustable rollers are provided in a typical dampening unit or inking unit, normally a number of valves corresponding to the number of actuators would be required, which large number of valves means a large outlay in technical apparatus. This large outlay is avoided by providing a switching device, by the use of which switching device, the control valves can be selectively connected with different actuators. This means that the adjustable rollers cannot all be adjusted at the same time. Instead, only those actuators, which are connected with the control valves via the switching device, can be operated. Depending on the configuration of the inking unit or the dampening unit, a few valves are sufficient for use in adjusting the entire inking or dampening unit, by the use of which few valves, the contact pressure of the different adjustable rollers can be set.

In accordance with a preferred embodiment of the present invention, only two valves are provided, by the use of which two valves the pressure exerted on two actuators, at an adjustable roller, can be set simultaneously. The process for setting the different adjustable rollers is performed in such a way that one adjustable roller is adjusted by operating the two valves and, following the adjustment of that one roller, the setting of that roller is fixed by operating a suitable fixation device. Following this fixation, the adjustment of the next adjustable roller can follow.

In accordance with the method of the present invention, an angular position of the second roller, against which the first roller can be pressed with an adjustable contact pressure, is determined. By controlling this angular position of the second roller, it is possible that the pressing, or the placement of the adjustable roller is then performed only in defined positions of the second roller.

This type of control of the pressure is important particularly in connection with forme cylinders on whose circumference fastening assemblies, for use in fastening the printing plates on the forme cylinder, are provided. If the adjustment or the bringing into contact of the adjustable rollers is performed at an angular position in which the adjustable roller comes to rest on the fastening device of the forme cylinder, the adjusted values are distorted because of the changed diameter of the forme cylinder in the area of the fastening device. This distortion can be avoided by controlling the angular position of the second roller.

In accordance with a further preferred embodiment of the present invention, the setting of the contact pressure and/or the placement of the first roller against the second roller takes place during simultaneous rotation of both of the rollers.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
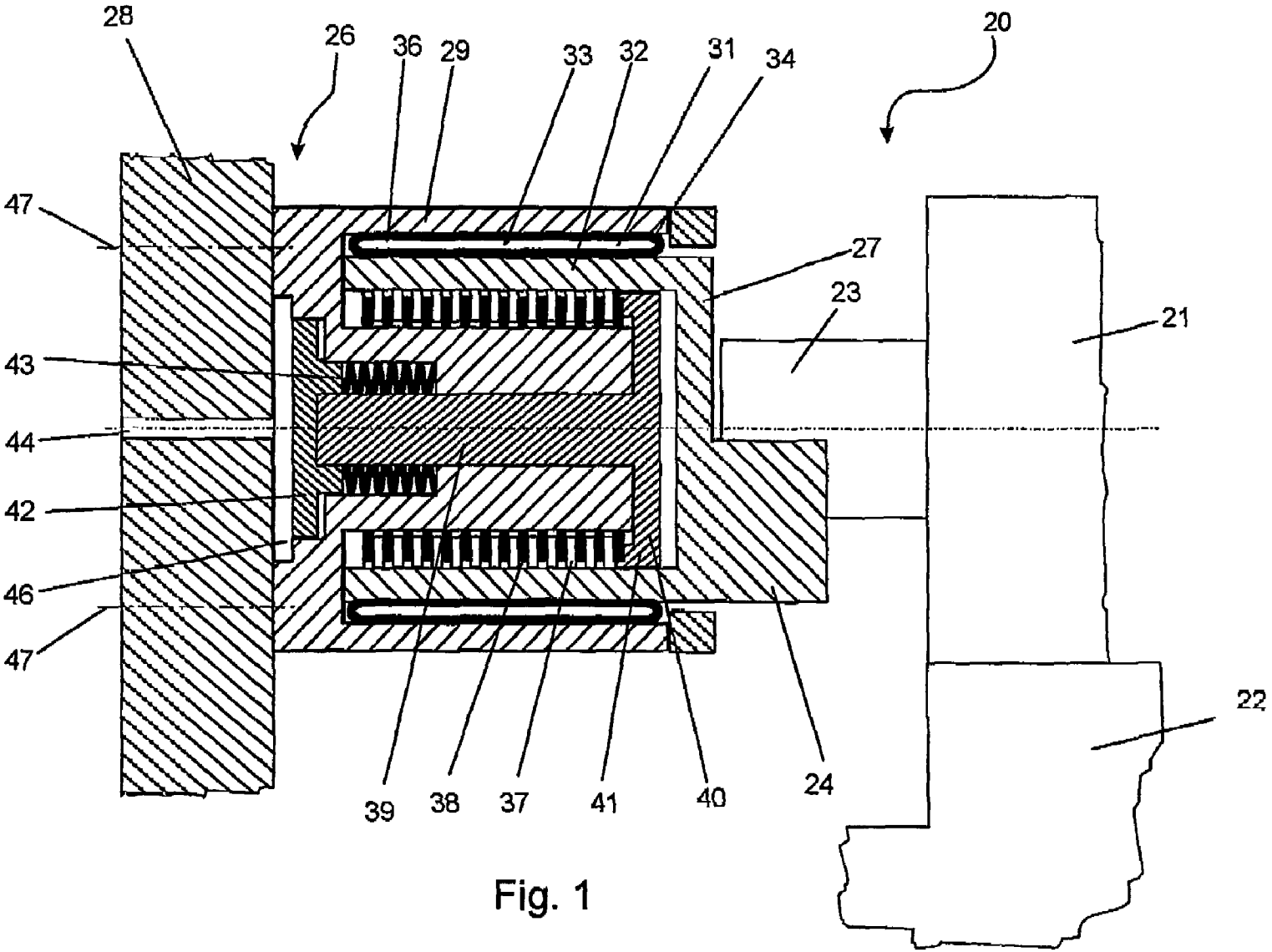
FIG. 1, a schematically represented device, in longitudinal section, and in accordance with the present invention, for setting a contact pressure between two rollers, in FIG. 2, a schematic cross-sectional view of the device, in accordance with the schematic representation in FIG. 1, in a base position, in FIG. 3, a view similar to FIG. 2 and with the device, in accordance with the schematic representation in FIG. 1, in a deflected position, in FIG. 4, the device in accordance with FIG. 1 in a perspective front view, in FIG. 5, a cross-sectional view of a second preferred embodiment of an actuator for a device in accordance with the present invention, in FIG. 6, an inking unit with several adjustable rollers adapted for placement against a forme cylinder, and in FIG. 7, a switching device for the selective switching of two valves between different actuators.

Referring initially primarily to FIG. 1, there may be seen a device generally at 20, for setting the contact pressure between a first roller 21 and a second roller 22 in accordance with the present invention. The first roller 21 can be releasably fastened, by the end of its shaft 23, or its journal, at a quick-release locking device 24 provided on the device 20. Such quick-release locking devices are generally known from the prior art and typically have a semi-circular bearing shell, into which semi-circular shell the ends of the shaft 23 can be placed. By fastening an upper bearing shell, which is not specifically represented in FIG. 1, the shaft 23 can be fixed in place in the quick-release locking device 24.

The contact pressure setting device 20 is substantially put together from a frame holder 26 and a roller holder 27, which frame and roller holders 26 and 27, respectively can be displaced, in relation to each other, in an actuating plane that is extending perpendicularly, with respect to the drawing plane. The frame holder 26 is comprised of a base plate 28, which can be pivotably fastened, for example by the use of a pivot arm, on the frame of a printing press, and a sleeve body 29. On its side facing the roller 21, the sleeve body 29 has a recess 31, which is sized to be engaged by a cylinder-shaped section 32 of the roller holder 27. The interior diameter of the sleeve body recess 31, or the exterior diameter of the cylinder-shaped section 32 have been selected such that, in the base position depicted in FIG. 1, a circular-cylindrical, annular gap 33 of a gap width of from approximately 1 mm to 10 mm, and in particular a gap width of approximately 2 mm, results. The maximum actuation range, for displacing the roller holder 27 relative to the frame holder 26, is defined by the size of the gap 33.

Figure 4:
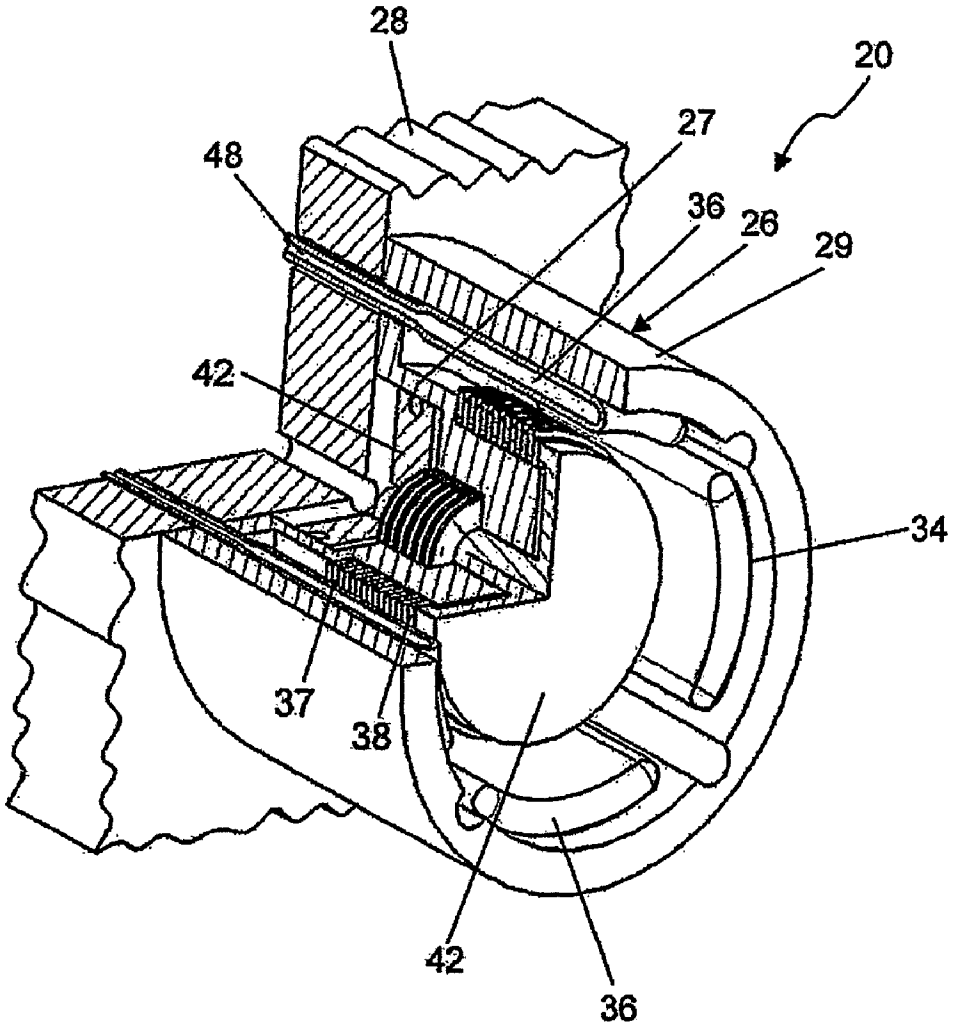

In order to be able to accomplish the actuation movement which is required for adjusting the first roller 21, or in order to obtain the desired contact pressure between the first roller 21 and the second roller 22, a total of four actuators 34, of which only two are shown in section in FIG. 1, and which are embodied in the form of pressure hoses 34, are arranged in the gap 33. These four actuators 34 are evenly distributed over the circumference of the annular gap 33. By the use of feed lines 48 which are not represented in FIG. 1, but which are shown in FIG. 4, pressure chambers 36, which are constituted by the walls of the actuators 34, can be charged with a fluid medium under pressure. Depending on the respective relative pressure conditions in the four pressure chambers 36 of the four actuators 34, a resulting force acts on the roller holder 27. The roller 21 can thus be pressed, with the desired contact pressure, against the roller 22 by an appropriate control of the pressure in the actuators 34. Since the air cushion, which is under pressure in the pressure chambers 36 of the four actuators 34, is compressible, it is possible, by use of the resulting spring effect, to intercept mechanical interferences.

To fix the roller holder 27 in place, relative to the frame holder 26, plate elements 37 are fastened on the roller holder 27. These roller holder plate elements 37 are arranged to mesh with cooperating plate elements 38 fastened on the sleeve body 29, thus forming a multi-disk packet. For clamping the multi-disk packet formed from the plate elements 37 and 28 in a frictionally connected manner, a T-shaped plunger 39 is provided. Plunger 39 includes a circular plunger head 40 which is provided with a plunger head circular flange 41 that is engageable against an outermost plate element 37 or 38 of the multi-disk packet. A pressure plate 42 is fastened on the end of the plunger 39 opposite the circular flange 41, and on which pressure plate 42 the spring force of a spring element 43, which is embodied in the manner of a plate spring package 43, acts. The spring element 43 is mounted, prestressed, between the pressure plate 42 and the sleeve body 29. The multi-disk packet constituted by the plate elements 37 and 38 is thereby clamped, by the spring force, which is transmitted from the plunger 39 to the plate elements 37 and 38.

To displace the roller holder 27 relative to the frame holder 26, in particular when adjusting the contact pressure between the rollers 21 and 22, the fixation device, which is constituted by the plate elements 37 and 38, or by the plunger 39 and the pressure plate 42, must be released. For this purpose, a pressure connector 44 is provided in the base plate 28. A pressure chamber 46, formed between the pressure plate 42 and the base plate 28, can be charged with a pressure medium, such as, for example, compressed air which is introduced into the pressure chamber 46 through the pressure connector 44. As soon as the air pressure in the pressure chamber 46, and acting on the pressure plate 42, exceeds the spring force of the spring element 43, the plunger head circular flange 41 of the plunger 39 is lifted off the outermost plate element 37 or 38. These plate elements 37 and 38 are no longer clamped in a frictionally connected manner and can be displaced in relation to each other.

Adjustment of the contact pressure between the rollers 21 and 22 takes place, for example, in the following manner. First, the pressure chamber 46 is charged with sufficient pressure, through the pressure connector, so that the plate elements 37 and 38 are no longer clamped in a frictionally connected manner. Subsequently, the actuators 34 are each charged with just enough pressure that the desired contact pressure between the rollers 21 and 22, or between the roller 21 and further rollers, which are not specifically represented in FIG. 1, is formed. This results in a contact strip of the desired width being formed between the cooperating rollers. As soon as the desired setting, with the desired contact pressure between the rollers 21 and 22 has been found, the pressure in the pressure chamber 46 is released. The plunger 39 then clamps the plate elements 37 and 38 together as soon as the roller holder 27 has been fixed in the desired position relative to the frame holder 28. Lastly, the pressure in the actuators 34 is released.

Figure 2:
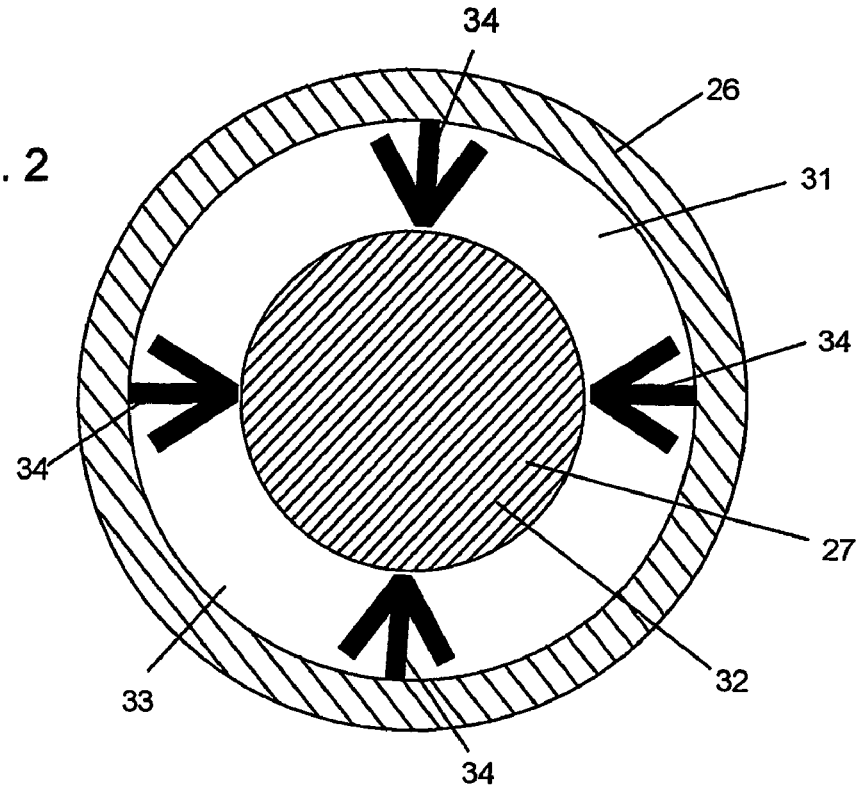
Figure 3:
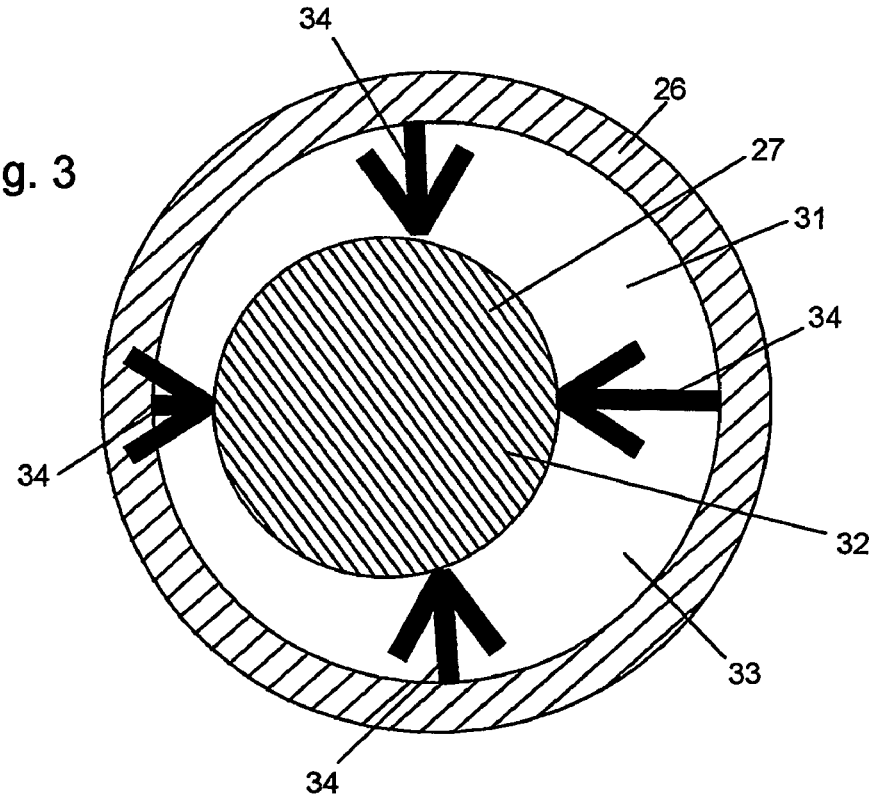

The operative principle of the device 20 during the required actuating movement is represented, in a schematic manner, in FIGS. 2 and 3. FIG. 2 shows the frame holder 26 with the recess 31 and the section 32 of the roller holder 27 engaging it. By the selection of the appropriate dimensions, a gap 33 is formed between the frame holder 26 and the section 32 of the roller holder 27, in which gap 33 the actuators 34, only represented by force arrows in FIGS. 2 and 3, are arranged. The possible actuating movements between the frame holder 26 and the roller holder 27 are defined by an actuating plane which, in the representation shown in FIGS. 2 and 3, extends in the drawing plane. The actuating range of the actuating movements is limited by the width of the gap 33.

As represented, by way of example in FIG. 3, the roller holder 27, and therefore, as a consequence, the roller 21 fastened to it, can be laterally displaced in relation to the frame holder 26, which lateral displacement is accomplished by an appropriate triggering of the actuators and the resultant force effect on the roller holder section 32. As soon as the desired position of the roller holder 27, in relation to the frame holder 26, has been found, the fixation device constituted by the plate elements 37 and 38, or by the plunger 39 and the pressure plate 42, can be actuated, so that the position is permanently fixed and the actuators 34 need no longer be driven.

In FIG. 4, the contact pressure setting device 20, with the base plate 28, is represented in a perspective front view. The sleeve body 29 is fastened by the use of four fastening screws 47 on the base plate 28, schematically represented in FIG. 1. Four actuators 34, which can be charged with compressed air via feed lines 48 and which are all embodied in the form of pressure hoses 34, are arranged between the sleeve body 29 of the frame holder 26 and the roller holder 27, on whose forward oriented side, the half-shell-shaped quick-release locking device 24 can be partially seen, as shown in FIG. 1. The recognizable plate elements 37 and 38 can be relaxed by operation of the pressure plate 42.

The extraordinarily compact construction of the device 20 can be appreciated which device 20, because of its entirely rotationally symmetrical design, except for the base plate 28, has a smaller diameter than the roller 21 itself, as may be seen in FIG. 1.

Figure 5:
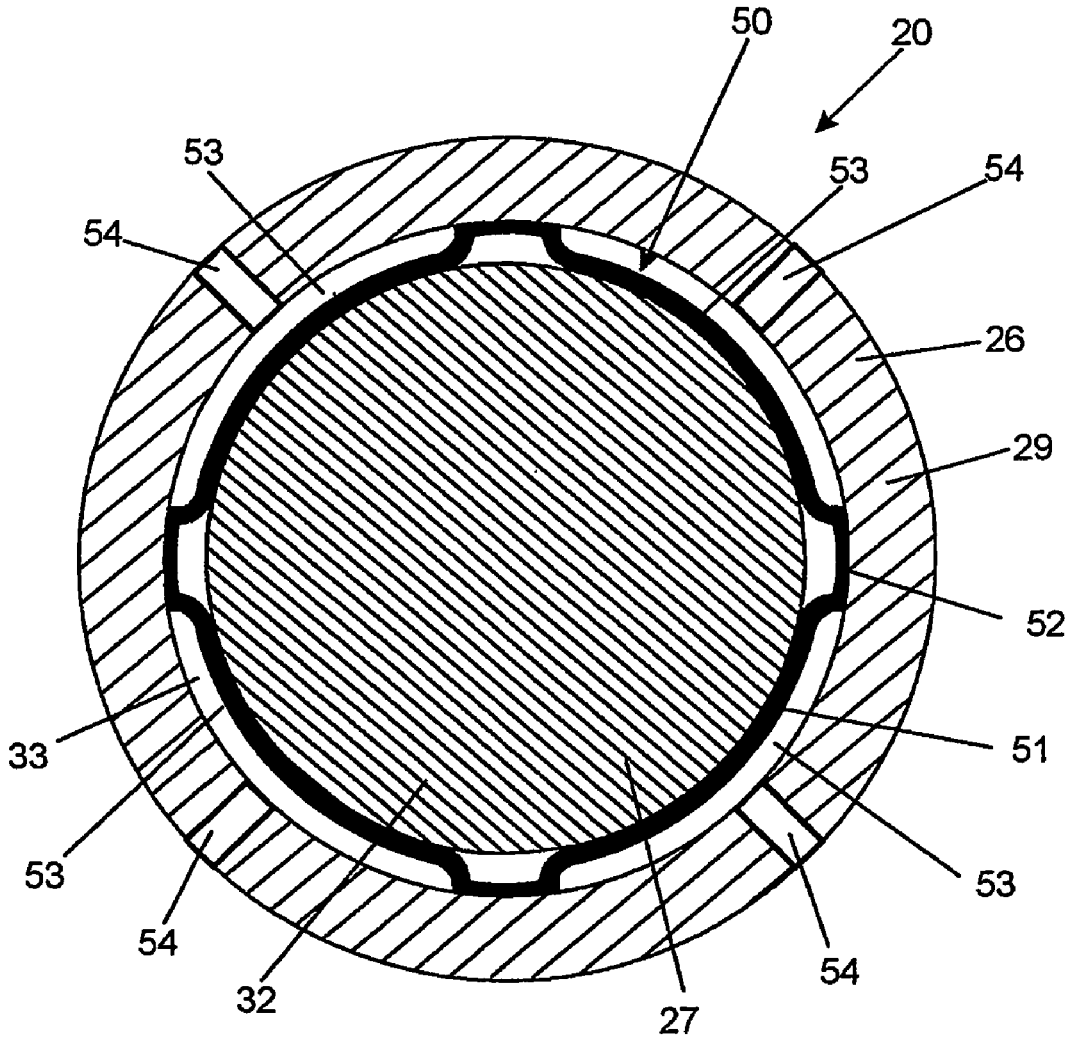

FIG. 5 shows, in cross-section, a second preferred embodiment of an actuator 50 for a device 20 in accordance with the present invention. The basic structure of the device 20, with a frame holder 26, a roller holder 27 and a fixation device for fixing the roller holder 27 in place relative to the roller holder 26 corresponds to the construction described in FIG. 1 and therefore need not be further explained in connection with this second preferred embodiment. A cylinder-shaped diaphragm 51, whose proximal and distal edges are connected with the interior diameter of the sleeve body 29, which is not specifically represented in FIG. 5, is arranged in the gap 33 to constitute the actuator 50. Moreover, the diaphragm 51 is connected, in four axially extending strip-shaped areas 52, with the interior diameter of the sleeve body 29, such as, for example by being glued in, so that, as a result, four pressure chambers 53 are formed by the sleeve body 29 and the diaphragm 51, which four pressure chambers 53 are evenly distributed over the circumference of the gap 33. The pressure chambers 53 can each be charged with compressed air via pressure inlet openings 54 so that, as a function of the respective pressure in the four pressure chamber 53, a resultant force acts on the section 32 of the roller holder 27.

Figure 6:
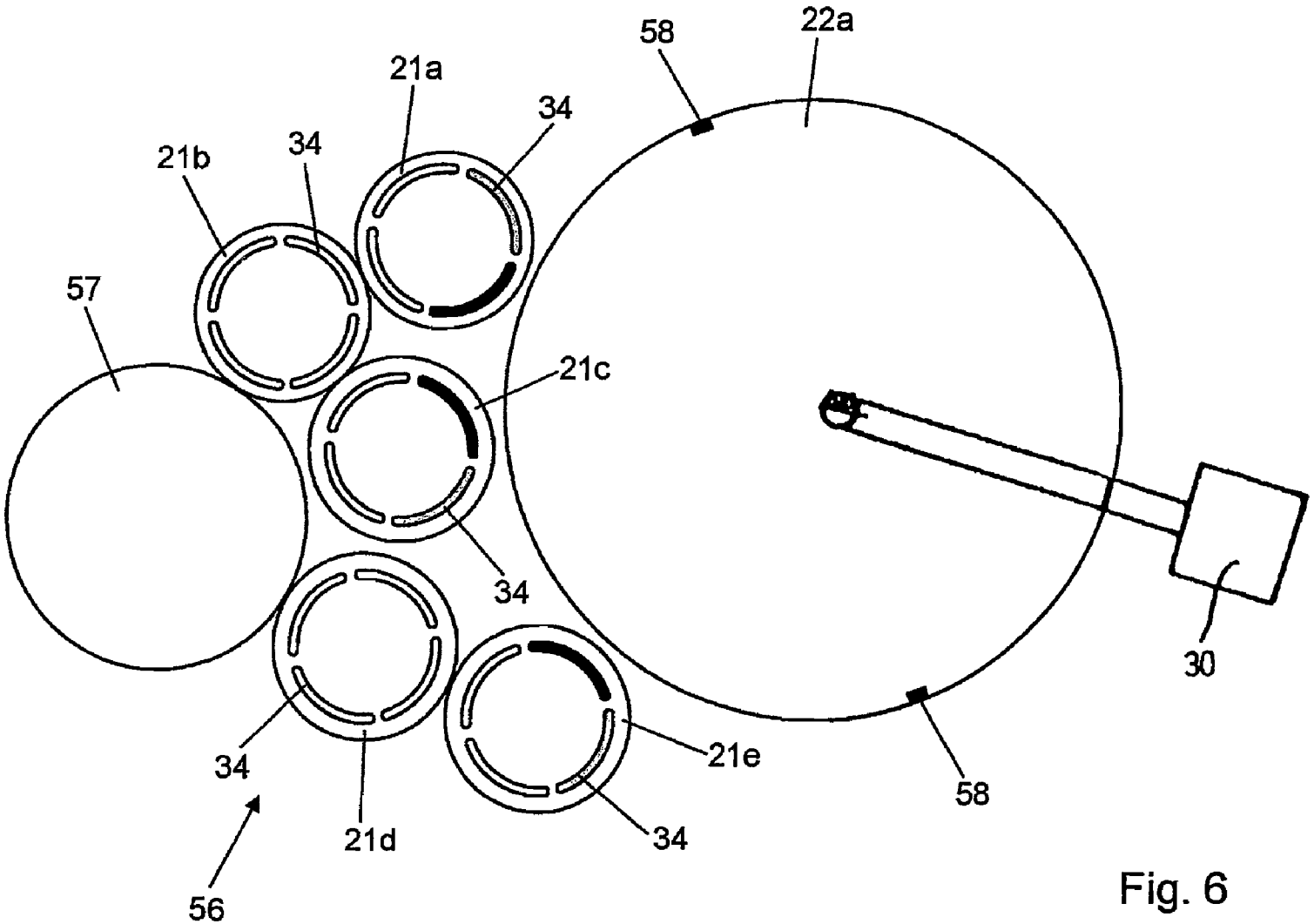

An inking unit 56 is represented in FIG. 6, by the use of which, printing ink can be transferred from a roller 57 to a roller 22*a* embodied in the manner of a forme cylinder 22*a*. Five adjustable rollers 21*a*, 21*b*, 21*c*, 21*d*, 21*e* are provided in the inking unit 58 for transferring the printing ink from roller 57 to forme cylinder 22*a*. The ends of the adjustable rollers 21*a* to 21*e* are each seated in contact pressure setting devices 20, which are indicated in FIG. 6 by the corresponding actuators 34.

Also, four or five rollers 21*a*, 21*b*, 21*c*, 21*d*, 21*e*, for example a dampening application roller and three or four ink application rollers, can be placed against the forme cylinder 22*a*.

The rollers 21*a*, 21*c*, 21*e* can be placed against the roller 22*a* by the corresponding actuators 34 being charged with pressure. After bringing the rollers 21*a*, 21*c*, 21*e* into contact, the contact pressure between the various rollers 57, 21*a* to 21*e*, 22*a* can be adjusted by charging the various actuators 34 at the rollers 21*a* to 21*e* with pressure.

One or several plate end fastening devices 58 or axially extending cylinder channels or breaks 58 are provided on the roller 22*a*, which fastening devices or breaks 58 are, in particular, each structured in the form of a gap 58. The front or the rear edges of a printing plate can be fixed in place in the fastening device 58, which is thus used for fastening the printing plate on the roller 22*a*. The angle of rotation of the roller 22*a* is detected by a sensor 30, which is represented schematically in FIG. 6, and this position is passed on to a control device. When placing the rollers 21*a*, 21*c*, 21*e* against roller 22*a*, or when setting the contact pressure of these rollers 21*a*, 21*c*, 21*e* against roller 22*a*, the respective angle of rotation of the roller 22*a* is taken into consideration in order to prevent, in this way, the rollers 21*a*, 21*c*, 21*e* resting against, or contracting the break 58 when being brought into contact, or when adjusting the contact pressure. The adjustment of the rollers 21*a* to 21*e*, or their being placed against the roller 22*a*, can also take place with the printing group rotating and with the roller 22*a* rotating. The adjustment of the contact pressure and/or the placement of the first rollers 21*a* to 21*e* against the second roller 22*a*, takes place at low numbers of rotation, in particular at speeds of from 3,000 to 5,000 revolutions/h.

Figure 7:
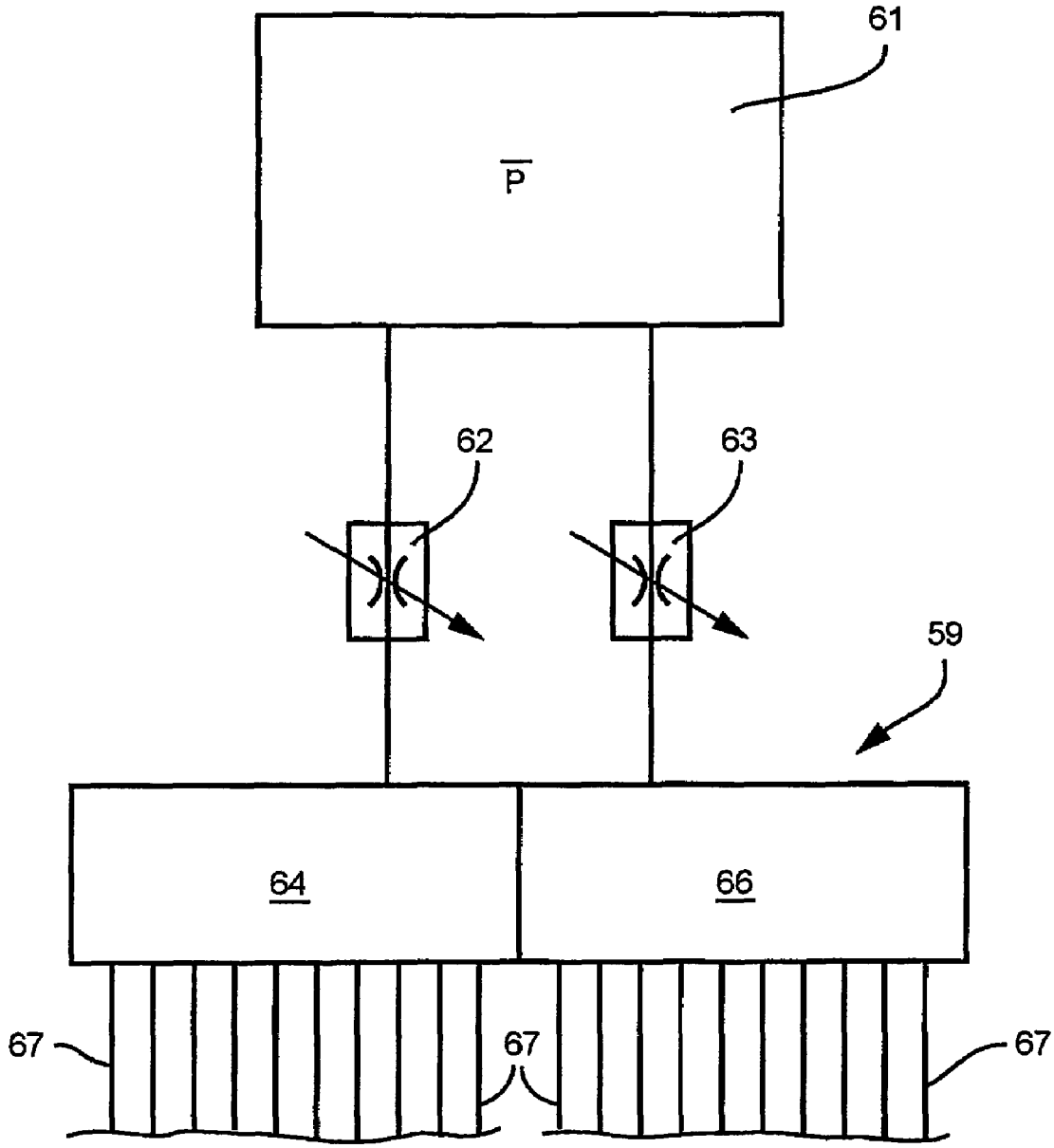

A switching device 59, as represented in FIG. 7, is suitable for controlling the totality of 20 actuators in the five adjustable rollers 21*a* to 21*e* on one side of the printing press. The switching device 59 is shown schematically in FIG. 7, and will be briefly explained in what follows.

A pressure medium, such as, for example, compressed air, can be taken, at a sufficiently high pressure level, from a pressure reservoir 61. The pressure medium flows via two valves 62, 63, and in particular via two pressure control valves 62, 63, into two separate pressure chambers 64, 66. A specific pressure level thus prevails in each of the separate pressure chamber 64, 66 as a function of the position of the respective pressure control valves 62 and 63 associated with each of the separate pressure chambers 64, 66. The pressure set in each of the two separate pressure chambers 64 or 66 can be transmitted to the actuators 34 associated with each such pressure chamber 64, 66 via pressure lines 67 assigned to each actuator 34.

Switching of the switching device 59 takes place in a clocked or timed manner. The length of a time pulse, for adjusting an adjustable roller 21*a* to 21*e* of the inking unit 56 or the dampening unit, is from 0.1 to 2 seconds, and, in particular, is 0.5 seconds.

Blocking arrangements, which are not specifically represented in FIG. 7, and which may be, for example, check valves, are provided in the switching device 59, so that it is possible to selectively block various ones of the pressure lines 67 connected to the pressure chambers 64 and 66. If the contact pressure is now to be set at an adjustable roller 21*a*, 21*b*, 21*c*, 21*d*, 21*e*, all of the pressure lines 67 leading to the actuators 34 for other rollers 21*a*, 21*b*, 21*c*, 21*d*, 21*e*, and not required for the adjustment of the selected roller 21, are blocked. The result of this is that the air pressure set by use of the pressure control valves 62, 63 is only transmitted to those actuators 34 which are involved in the adjustment of the respectively desired roller 21*a*, 21*b*, 21*c*, 21*s*, 21*e*. Following the adjustment of this specific roller 21*a*, 21*b*, 21*c*, 21*d*, 21*e*, the resultant contact pressure is set or held by operating the associated fixation device. The next adjustable roller 21*a*, 21*b*, 21*c*, 21*d*, 21*e* can be then adjusted by switching the switching device 59 to open the valves associated with that roller 21.

The following alternative is possible in place of the switching device 59 with its blocking arrangement.

The air pressures set by the two pressure control valves 62, 63 are simultaneously present at the actuators 34, 50 of several adjusting devices. An adjustment of the contact pressure takes place only at adjustment devices whose fixation device is opened.

The placement of the roller 21, 21*a*, 21*b*, 21*c*, 21*d*, 21*e*, to be put into contact with the surface area of the second roller 22, 22*a* takes place, in relation to the circumferential direction, at a distance of less than 20 mm from the leading end of the break 58.

Setting the contact pressure means that the contact pressure, in the state where the roller is placed against, or in contact with, another roller, can be changed prior to it being brought into such contact. In the contacted state, the surface pressure of the roller can be changed, in addition to the roller being moved to the disengaged state.

While preferred embodiments of devices and methods for setting the contact pressure of a displaceably mounted roller, in accordance with the present invention, have been set for fully and completely hereinabove, it will be apparent to one of skill in the art that various changes in, for example the overall sizes of the rollers, the source of the pressure medium, and the like can be made without departing from the true spirit and scope of the present invention which is accordingly to be limited only by the appended claims.

What is claimed is:

1. A method for setting a contact pressure between a displaceably seated first roller and at least a second roller of a printing press including:

supporting each of said displaceably seated first roller and said second roller for rotation;

supporting said displaceably seated, rotating first roller for displacement with respect to said second roller;

providing at least one actuator for said displaceably seated, rotating first roller;

using said at least one actuator for displacing said displaceably seated, rotating first roller into contact against said rotating second roller in a contact area;

providing an angle of rotation sensor for said rotating second roller;

providing a break in a surface of said rotating second roller;

using said angle of rotation sensor for determining a first angular position of said break in said surface of said rotating second roller; and contacting said displaceably seated, rotating first roller against said rotating second roller in said contact area at a second, defined angular position on said rotating second roller different from said first angular position of said break in said surface of said rotating second roller.

2. The method of claim 1 further including providing a plurality of said displaceably seated, rotating first rollers and placing each of said plurality of said displaceably seated, rotating first rollers against said rotating second roller each at a respective one of said second angular positions different from said first angular position of said break.

3. The method of claim 1 further including providing said rotating second roller as a forme cylinder having a plate fastening device in said break, and adjusting said contact pressure between said displaceably seated, rotating first roller and said forme cylinder when said displaceably seated, rotating first roller is out of contact with said plate fastening device in said break.

4. The method of claim 1 further including rotating said displaceably seated, rotating first roller at between 3,000 and 5,000 revolutions per hour.

5. The method of claim 1 further including contacting said rotating second roller with said displaceably seated, rotating first roller at said second defined angular position located along a circumferential distance of said rotating second roller of less than 20 mm from said break in said surface of said rotating second roller.

* * * * *